United States Patent [19]

McArdle

[11] Patent Number: 4,805,903

[45] Date of Patent: Feb. 21, 1989

[54] PARK BASKETBALL NET FIXTURE

[76] Inventor: James J. McArdle, 64-10 77th St., Middle Village, N.Y. 11379

[21] Appl. No.: 36,370

[22] Filed: Apr. 8, 1987

[51] Int. Cl.[4] ..... A63B 63/08

[52] U.S. Cl. ..... 273/1.5 R

[58] Field of Search ..... 273/1.5 R, 1.5 A; 210/473

[56] References Cited

U.S. PATENT DOCUMENTS

| | | | |
|---|---|---|---|
| 638,698 | 12/1899 | Bourie | 210/473 X |
| 1,544,453 | 6/1925 | Harbison | 273/1.5 R |
| 3,085,800 | 4/1963 | Holstad | 273/1.5 A |
| 3,160,414 | 12/1964 | Gray | 273/1.5 A |
| 3,446,504 | 5/1969 | Pascucci | 273/1.5 A |
| 3,799,543 | 3/1974 | Steele, Jr. | 273/1.5 A |
| 4,706,954 | 11/1987 | Kershaw | 273/1.5 A |

OTHER PUBLICATIONS

The American Heritage Dictionary, Second College Edition, Houghton Mifflin Co., ©1982, pp. 192 & 621: Boat Hook & Hook.

*Primary Examiner*—Paul E. Shapiro

*Attorney, Agent, or Firm*—Richard L. Miller

[57] ABSTRACT

This basketball net fixture is designed to be easily installed and removed from an existing park basketball hoop. Primarily, it consists of a circular main body with a lip having a magnetic strip to retain the main body to the hoop. A skirt of the main body is also provided with cut-out openings around it for receiving and retaining cord portions of a net that depends from the fixture for a basketball to pass through, and a boat hook is employed to elevate, install, and remove the fixture from the hoop.

6 Claims, 1 Drawing Sheet

PARK BASKETBALL NET FIXTURE

BACKGROUND OF THE INVENTION

The instant invention relates generally to net fixtures for sports, and more particularly, to a park basketball net fixture.

Numerous net fixtures have been provided in the prior art that are adapted to specific sports. While these units may be suitable for the particular purpose to which they address, they would not be as suitable for the purpose of the present invention as hereafter described.

SUMMARY OF THE INVENTION

A primary object of the present invention is to provide a park basketball net fixture that will overcome the shortcomings of the prior art devices.

Another object is to provide a park basketball fixture, which will be unique in design for employment at outdoor park and basketball courts.

An additional object is to provide a park basketball net fixture, which will be of such design, as to overcome the objectionable problems encountered in such parks and courts.

This invention is of such design, as to be employed by the athletes who play basketball particularly in outdoor parks and school-yard courts in cities and surrounding areas, and it is a device which allows the putting up and the taking down a basketball net easily and efficiently, enabling the game to be played with the white nylon net that the game was meant to be played with. The structure is such, that it is provided with a 180 degree magnetic body to which a net is readily attached, because there are no hooks or loops to attach a net to a school-yard or park hoop tht is already mounted in such environment. Park and school-yard hoops have no means of attaching a basketball net, but there is an obsolete method of putting up a net on a hoop which is taping it there, which are very dangerous, as it means sitting on the hoop and possibly falling therefrom and injuring the person badly in doing so. Further, it is a waste of time because the net will not last long, as it comes down net link by net link by the force of the ball or people hitting it. Also, leaving the taped net up overnight, is not a very good idea, because the chances are against any one that it will still be there on the hoop for play the next day. People also steal these nets for their own basketball courts, or people simply tear them down. The net could also be put up by the use of a ladder or chair and then taping it up there, however, this is also a waste, because it comes down, and lugging a ladder or a chair to a ball park every time a player wants to play, would be almost ridiculous.

In most city parks and school-yard basketball courts, there is no way of installing a net properly, and adult players and children are deprived of the full concept of playing basketball with a net. It isn't right, not only because it is not as much fun, but a properly hung net serves a very important function and that is the reason that a net on the hoop in professional basketball is always employed. When a net is employed, it not only provides a nice swishing sound, but it gives a player a much better visual perception of what the player is looking at. The net also shows precisely whether or not the basketball passed through the hook for score. Also, when playing with friends without referees, one cannot always tell if the basketball passed through or not, and this can cause time consuming arguments that interrupt the game and almost always does bring out cheaters and liars who will say that the ball went in or did not go in, just so they can say they win the game.

The net will also pick up the speed of the game and when a ball passes through the hoop without a net, it does not come straight downward, it keeps going in the same direction or another (as from where the shot was taken) and is retrieved by a player who runs the ball down, so as to put it in play again. Also, when the ball passes through a hoop with a net, it picks up a spinning action that drops the ball straight down from the basket, to be easily picked up to be put back into play. The present invention also is installed and removed by telescoping boat hook or firefighters hook tool.

A further object is to provide a park basketball net fixture that is simple and easy to use.

A still further object is to provide a park basketball fixture that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 1:
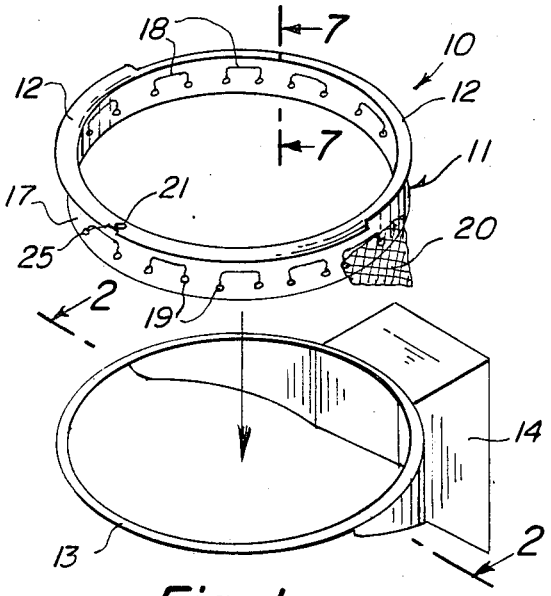
FIG. 1 is a perspective view of the present invention, shown prior to being installed on a basketball hoop.
Figure 5:
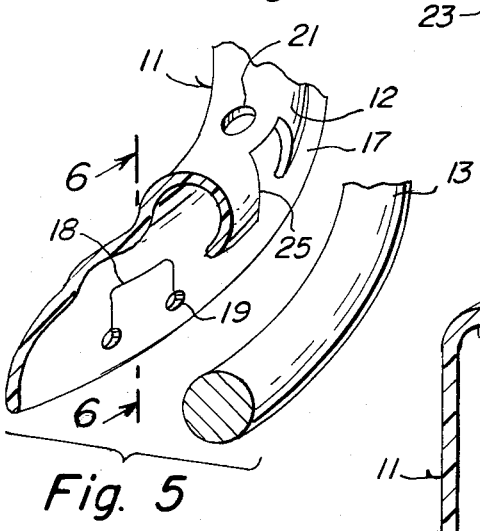
Figure 4B:
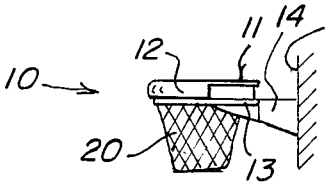
Figure 7:
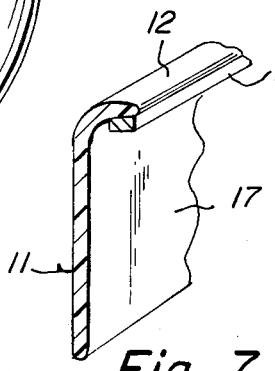
Figure 6:
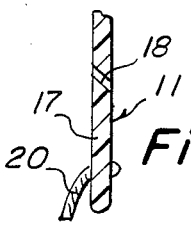

FIGS. 4*a* through 4*d* are diagrammatic side views of the invention, showing the various stages of installation and removal from the rim;

FIG. 5 is an enlarged fragmentary perspective view of the hoop and fixture, shown partly in section;

FIG. 6 is a cross-sectional view, taken along the line 6—6 of FIG. 5, and FIG. 7 is a cross-sectional view, taken along the line 7—7 of FIG. 1.

DETAILED DESCRIPTION OF THE PREFERRED EMBODIMENTS

Figure 3:
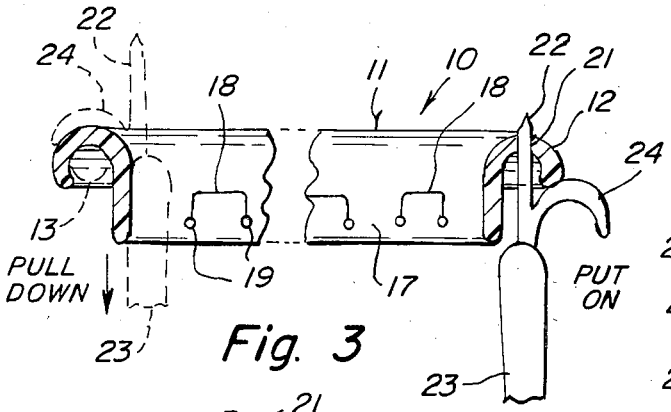
FIG. 3 is similar to FIG. 2, but demonstrates the stages of installation and removal of the fixture.
Figure 4A:
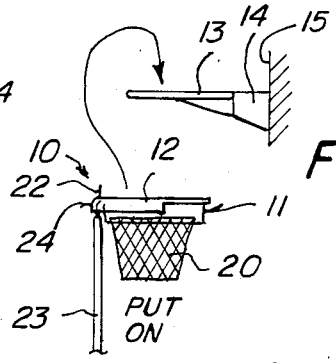
Figure 4C:
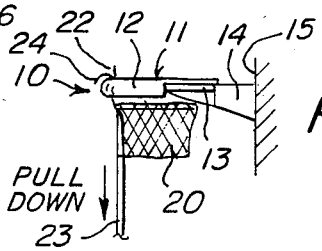

Turning now descriptively to the drawings, in which like reference characters denote like elements throughout the several views, a fixture 10 is shown to include a cylindrical main body 11 having a curved lip portion 12 formed in the upper end portion thereof. Lip 12 is designed to engage over a typical basketball hoop 13 mounted to a bracket 14 secured to a backboard 15, as is illustrated in FIGS. 4*a* through 4*d*. A magnetic strip 16 is suitably fixedly secured to a portion of the underside of lip 12, for magnetically adhering to the hoop 13 fabricated of a ferrous metal, and the skirt 17 portion of main body 11, is provided with a plurality of inverted and U-shaped cut-outs 18 that are equally spaced from each other and terminated at their end portions by openings 19 therethrough skirt 17, for preventing tearing. The main body 11 is preferably fabricated of a resilient plastic, enabling the cut-outs 18 to be urged outward to receive top portions of a typical nylon net. When placed therein, the cut-outs 18 serve to spring back the material of 11 and retain the net 20 firmly, and it shall be noted that mesh cords of the net 20 are held in the openings 19. For installation of the fixture 10, at least one opening 21 is provided through main body 11 for receiving the spike 22 and a boat hook 23, so as to lift main body 11 above the hoop 13, and the hoop portion 24 is employed to pull main body downward to engage the hoop 13, as best seen in FIGS. 4*c* and 3(left).

In use, the cut-outs 18 are forced open one at a time and the top cord portions of the net 20 are inserted therein until they fall into the openings 19. The main body 11 is then elevated above the basketball hoop 13 by the insertion of the spike 22 of the boat hook 23 into the opening 21 of the main body 11. The spike 22 is then removed from the opening 21 and the hook portion 24 is employed to engage with the top of the lip 12. With a downward motion the hook portion 24 urges the skirt 17 down, whereupon the magnetic strip 16 adheres to rear portion of hoop 13, while the forward portion of the hoop 13 is mechanically captured by the lip 12 per se which is C-shaped and snaps around the hoop as best seen in FIGS. 2(phantom) and 5.

Figure 2:
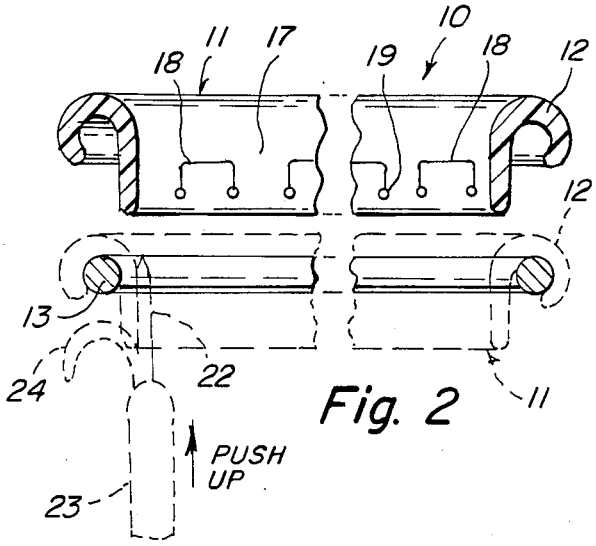
FIG. 2 is a enlarged and fragmentary cross-sectional view, taken along the line 2—2 of FIG. 1, and illustrates the instant invention removed from the hoop; and also in phantom the hook in position ready to remove the instant invention from the hoop.
Figure 4D:
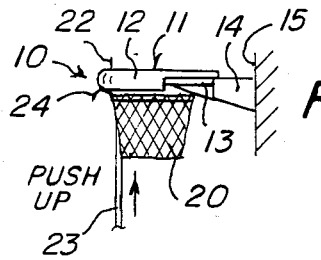

Conversely when it is desire to remove the fixture 10 with its attached net 20, the boat hook 23 is placed under the main body 11, against skirt 17 and pushed upwardly dislodging the fixture 10 from the hoop 13, as best seen in FIGS. 2 and 4d. Then the spike 22 is again employed in the opening 21, as best seen in FIGS. 4*a* and the 3(right), the boat hook 23 is lifted and the fixture elevated from contact with the hoop 13 enabling fixture 10 to be used again upon hook 13 at another time. A notch 25 facilitates the easy entry of the spike 22 into opening 21, because in this situation the hoop 13 would otherwise be in the way.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A park basketball fixture, comprising, a main body for being received removably on a mounted basketball hoop, a magnetic strip secured to said main body, for magnetically adhering said main body to said hoop, a net removably received on said main body, and a boat hook provided for the installation and removal of said fixture from said hoop, and wherein said main body is circular in shape, is of a resilient material, and includes a bottom skirt with an integrally attached and arcuate lip, and said skirt is received within the confines of said basketball hoop, and wherein equally spaced cut-outs are provided through said skirt of said main body, causing portions of said skirt to be urged inward or outward, and cord portions of said net are engaged within the confines of the cut-outs that retain and support said net from said main body and said hoop.

2. A park basketball fixture as set forth in claim 1, wherein a magnetic strip is fixedly secured to the underside of said lip and magnetically adhere to the top portion of said hoop, preventing the dislodging of said fixture from said hoop when said fixture is in use.

3. A park basketball fixture as set forth in claim 1, wherein a vertical opening is provided through said lip of said main body and removably receives a spike of said boat hook, and when said spike is in vertical opening and said boat hook is elevated, said fixture is elevated in the confines of said hoop, and when a hook portion of said boat hook is engaged with the top of said lip and said boat hook is lowered, said hook portion urges said fixture downward and imgages said lip with said hoop.

4. A park basketball fixture, comprising a main body for being received movably on a mounted basketball hoop, mechanical means for adhering said main body to said hoop, a net removably received on said main body, and a boat hook provided for the installation and removal of said fixture from said hoop, and wherein said main body is circular in shape, is of a resilient material, and includes a bottom skirt with an integrally attached and arcuate lip, and said skirt is received within the confines of said basketball hoop, and wherein equally spaced cut-outs are provided through said skirt of said main body, causing portions of said skirt to be urged inward or outward, and cord portions of said net are engaged within the confines of the cut-outs that retain and support said net from said main body and said hoop.

5. A park basketball fixture as set forth in claim 4, wherein said mechanical means for adhering said main body to said hoop is a C-shaped lip which snaps around a front portion of said hoop, preventing the dislodging of said fixture from said hoop when said fixture is in use.

6. A park basketball fixture as set forth in claim 4, wherein a vertical opening is provided through said lip of said main body and removably receives a spike of said boat hook, and when said spike is in vertical opening and said boat hook is elevated, said fixture is elevated in the confines of said hoop, and when a hook portion of said boat hook is engaged with the top of said lip and said boat hook is lowered, said hook portion urges said fixture downward and imgages said lip with said hoop.

* * * * *